US005193806A

United States Patent [19]

Burkly

[11] Patent Number: 5,193,806

[45] Date of Patent: Mar. 16, 1993

[54] LOW-FLIGHT SPIN CONTROL CHIPPER-PUTTER GOLF CLUBHEAD

[76] Inventor: Alfred J. Burkly, P.O. Box 787, West Falmouth, Mass. 02574

[21] Appl. No.: 878,534

[22] Filed: May 5, 1992

[51] Int. Cl.[5] ..... A63B 53/04; A63B 53/02

[52] U.S. Cl. ..... 273/80.2; 273/167 C; 273/171; 273/167 A; 273/167 J

[58] Field of Search ..... 273/167–175, 273/77 R, 77 A, 80 R, 80.2, 67 C, 67 D, 80 C, 193 R, 194 R, 164.1, 164.2; D21/210, 211, 214–220

[56] References Cited

U.S. PATENT DOCUMENTS

| | | | |
|---|---|---|---|
| 1,116,022 | 11/1914 | Cornwall | 273/167 C |
| 1,177,266 | 3/1916 | Pedersen | 273/167 C |
| 3,908,996 | 9/1975 | Molinaro | 273/175 X |
| 3,909,005 | 9/1975 | Piszel | 273/175 X |
| 3,989,257 | 11/1976 | Barr | 273/167 J X |
| 4,508,342 | 4/1985 | Drake | 273/167 C |
| 4,776,594 | 10/1988 | Rango | 273/167 A X |
| 4,792,140 | 12/1988 | Yamaguchi et al. | 273/173 |
| 4,828,266 | 5/1989 | Tunstall | 273/171 |
| 4,861,038 | 8/1989 | Fucinato | 273/167 C X |
| 4,872,684 | 10/1989 | Dippel | 273/167 C X |
| 4,881,737 | 11/1989 | Mullins | 273/167 C X |
| 5,090,698 | 2/1992 | Kleinfelter | 273/167 C X |

FOREIGN PATENT DOCUMENTS

| | | | |
|---|---|---|---|
| 359356 | 10/1931 | United Kingdom | 273/67 C |
| 1008972 | 11/1965 | United Kingdom | 273/167 C |
| 1470768 | 4/1977 | United Kingdom | 273/171 |

*Primary Examiner*—V. Millin
*Assistant Examiner*—Sebastiano Passaniti

[57] ABSTRACT

Two embodiments are disclosed for a right circular cylindrical shaped golf clubhead which, when provided with the essential shafts and gripping devices, can be used for chipping and putting a golf ball with low flight trajectory and pronounced rotational overspin and backspin characteristics. The preferred embodiment is manufactured from tropical hardwoods and has a geometry based on functions of a base diameter "D" of an impacting cylinder. The clubhead comprises tapered underfaces, a tapered heel face, grooving on portions of the impact surface to promote spin momentum, swingweight ports, swingweighting material and an upright shaft and ferrule. A second embodiment is metallic in construction, employs the same base diameter "D" an operates on the same principles as the preferred embodiment, except that the clubhead cylinder is curved along its horizontal centerline and is of uniform circular section over its entire length. The clubhead comprises a metallic curved tube having swingweight and closure caps, grooving for spin effect on the full length of portions of the cylinder, and a metallic hosel provided for the purpose of attaching a standard golf club shaft.

2 Claims, 4 Drawing Sheets

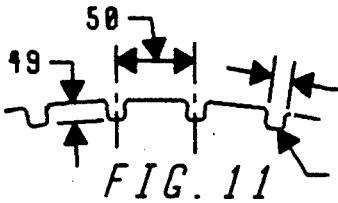
FIG. 11
FIG. 12
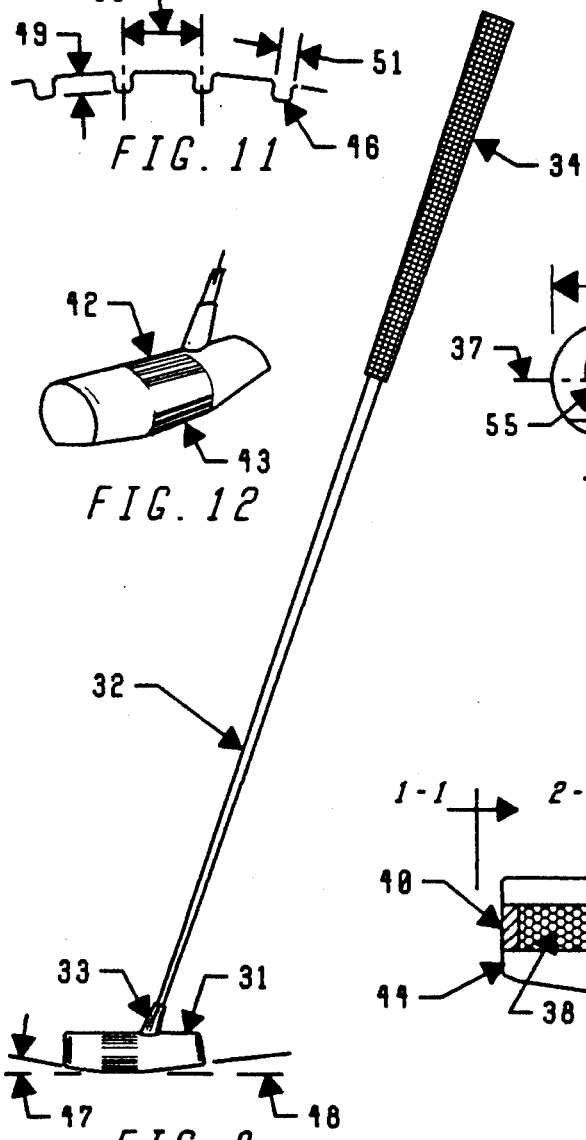
FIG. 8
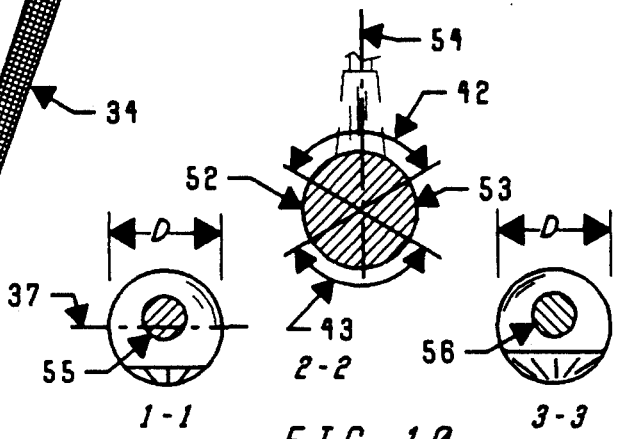
FIG. 10
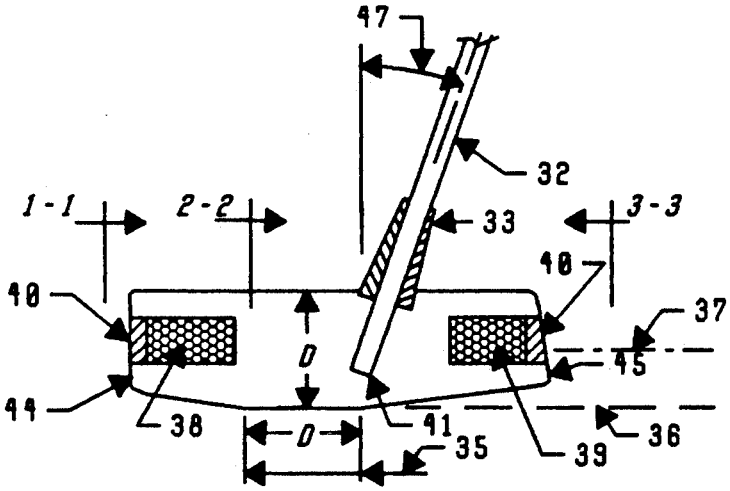
FIG. 9

FIG. 16
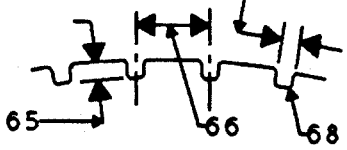
FIG 15
FIG. 18
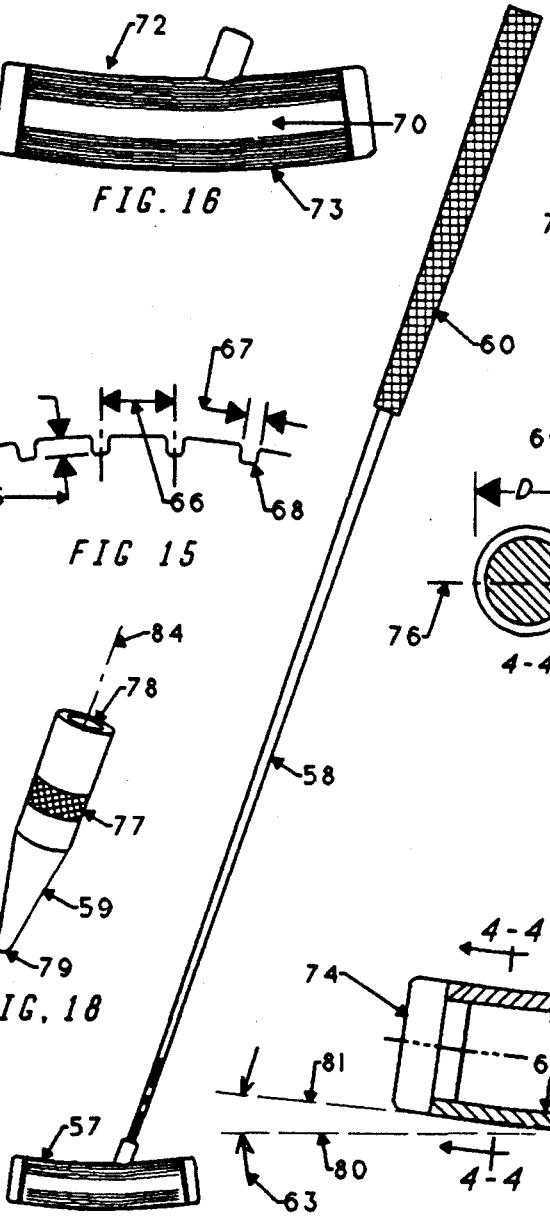
FIG. 13
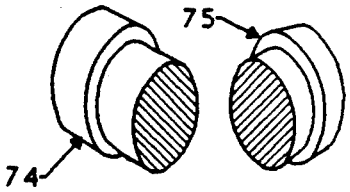
FIG. 19
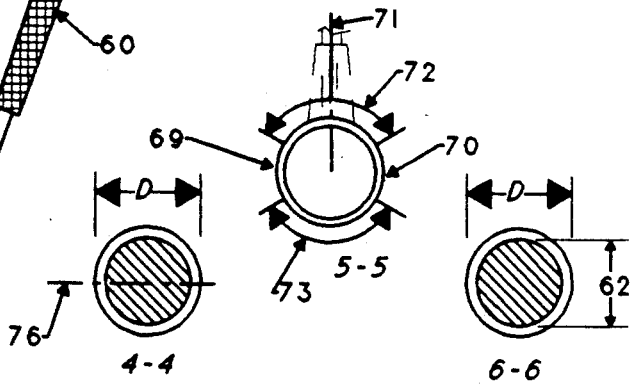
FIG. 17
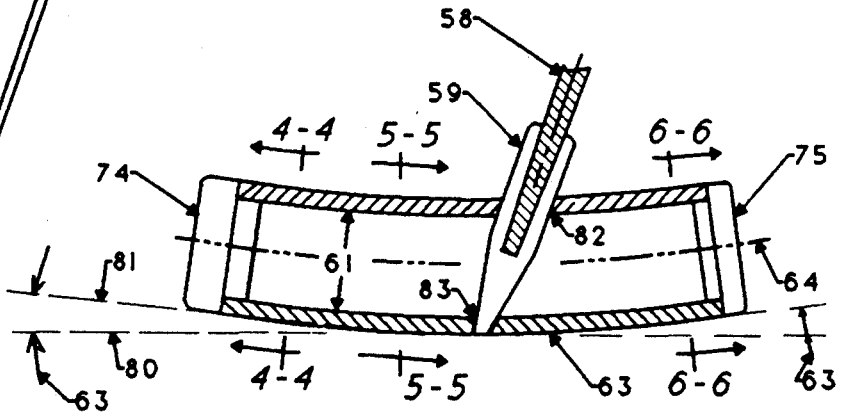
FIG. 14

LOW-FLIGHT SPIN CONTROL CHIPPER-PUTTER GOLF CLUBHEAD

BACKGROUND OF THE INVENTION

1. Field of the Invention

This invention relates to a golf club which can be used by an average player in the game of golf. Specifically, it relates to the clubhead of a golf club assembly which is manufactured for the purposes of chipping a golf ball up and onto the putting green surface, and also putting the ball into the hole. In each case, a significant magnitude of the momentum imparted to the golf ball by the clubhead appears as angular momentum in the form of rotational spin in the forward or backward direction.

2. Prior Art

There are many existing forms and manufactures of golf clubs having clubheads manufactured for chipping. There are also clubheads on golf clubs used for putting which are generally cylindrical in form or are of partially cylindrical construction. However, there does not appear to be any golf club presently known having a clubhead which combines the principles of mechanics and geometry ofmanufacture which afford the performance characteristics achievable with the present clubhead invention for low trajectory chipping and for putting.

SUMMARY OF THE INVENTION

Chipping and putting are both an art and science. Control of golf ball motion while bouncing and rolling toward the pin and hole is the essence of the short game. The primary objective of the present invention is ball control. This is achieved in part by the present invention clubhead geometry, which produces maximum rotational spin in positive and negative directions while maintaining directional stability in linear translation. Ball control is further enhanced with the present invention because it reduces the height of chipping trajectory to an approximate maximum of 9 to 15 inches above the ground regardless of the force of the golfer's swing. The present clubhead invention geometry is derived from the basic deduction that these characteristics can be obtained with a clubhead having a cylindrical center impact section, the diameter of which is smaller than the golf ball being struck.

Many golfers choose among iron clubs with different loft angles to make shots from various ball lies, or which might require traversing varying distances of carry and roll over curving surfaces; for example, a No. 5, 7 or 9 iron. Some golfers use a special chipping iron for almost all chipping situations from about fifteen yards out from the green. There has always been a desire to simplify club selection and mastery for the myriad situations encountered in the short game from fringe to pin. The present invention would permit using only one club from fifteen yards out from the green toward the pin and into the hole. Only one club need be mastered for most chipping lies within this distance, and for all putts regardless of lie. Because of its symmetrical shape it can be used to swing from a right or left handed stance. The average golfer plays without a caddy to handle his clubs, and usually carries several clubs from cartpath or bag-drop areas to green areas to play the short game from fringe or light rough onto the green and into the cup. The player's game speeds up because there are fewer decisions to be made and fewer trips back to the bag for a change in club selection. There is also the intangible benefit the average player gets from not having to remember to pick up clubs used for chipping when leaving the green after putting out.

The utility of this invention has been tested to the extent that the Applicant has developed and built several prototype clubs of this manufacture and has personally used them in seclusion and secrecy on three regulation golf courses through approximately eighty holes of play. The performance characteristics have been consistent with a low flight trajectory of about 12 to 18 inches above the ground regardless of impact force, and a distinctly noticable spin effect when chipping and putting. The spin effect when chipping was enhanced by the addition of grooving on portions of the clubhead face of one of the later prototypes. The clubhead face is not grooved on that portion of the face area which impacts the ball on medium to short range putts. An unexpected advantage was noticed during the prototype test period with respect to mis-hit shots. Picking one's head up during the swing, known as "peeking", is a common cause for smothering a shot so badly that the ball barely moves foward at all on a chip shot. This occurs because the golfer's pin-facing shoulder comes up with the head and causes the swing arc to tilt upward also. The result is a shot which is smothered by the heel of a conventional flat bladed clubhead. Under such circumstances, the invention prototype was observed to impart significant forespin as the clubhead struck the golf ball above center, causing the ball to skip forward with considerable rotational momentum. It was this observation during the test and development period which led to the addition of grooving on the bottom face of the clubhead, thus enhancing this apparent advantage by increasing the forespin effect.

The clubhead is provided with a shaft which is inserted at a preferred lie angle of 70 degrees. This angle compares with 72 degrees for the average putter and 62–65 degrees for flat-faced irons used for chipping. The bottom face of the clubhead is tapered on the toe and heel ends by a preferred 8 degrees to permit the golfer to address the ball at a lie angle of 20 degrees, or optionally to address it within limits of 62–78 degrees. This feature, in association with variation of swing arc stances, permits a broad shot-making capability while chipping without fear of digging the heel or toe of the clubhead into the turf and deflecting the swing arc. In fact, this feature is necessary to proper operation of the clubhead on uneven turf or rough.

The clubhead is provided with a means for swingweighting and balancing the assembled golf club with heel and toe swingweight ports. This provision is necessary to fine tune an individual club, and to establish inital clubhead weight depending on the density of the hardwood material selected for its manufacture.

The choice of dense hardwood materials for clubhead manufacture is based primarily on the excellent resilience of these woods and the vibrational "feel" they afford on delicate shots. They are kept in good preservation and dull lustre with ordinary furniture oil, and do not require application of flammable solvents, sealers or varnishes for waterproofing.

A second embodiment of the clubhead invention represents a less expensive clubhead manufacture of all metallic construction which lends itself well to mass production. A prototype of this construction is now being made.

BRIEF DESCRIPTION OF THE DRAWINGS

FIGS. 8 through 12 show the general arrangement and details of the preferred embodiment of the invention. FIGS. 13 through 19 show the general arrangement of a second embodiment of the invention. Successively, the drawings illustrate the following:

FIG. 1—Force lines of action chipping with a No. 7 iron

FIG. 2—Force lines of action chipping the invention

FIG. 3—Free rolling discs on flat and yielding surfaces

FIG. 4—Invention, chipping with flat swing arc

FIG. 5—Invention, chipping with downward swing arc

FIG. 6—Invention, chipping with upward swing arc

FIG. 7—Invention, putting on flat and inclined green surfaces

FIG. 8—Preferred embodiment-Arrangement of club

FIG. 9—Preferred embodiment-Clubhead assembly and details

FIG. 10—Preferred embodiment-Sections

FIG. 11—Preferred embodiment-Groove detail

FIG. 12—Preferred embodiment-Groove arrangement

FIG. 13—Second embodiment-Arrangement of club

FIG. 14—Second embodiment-Clubhead assembly and details

FIG. 15—Second embodiment-Groove detail

FIG. 16—Second embodiment-Extent of grooving

FIG. 17—Second embodiment-Sections

FIG. 18—Second embodiment-Hosel

FIG. 19—Second embodiment-Swingweight end caps

DETAILED DESCRIPTION

The underlying theory of the preferred embodiment of the invention is supported in part by graphics of mechanical motion illustrated in FIGS. 1 through 7. FIGS. 8 through 12 depict the preferred embodiment of the invention. The underlying theory and graphics described and depicted herein for the preferred embodiment also apply to the second embodiment of the invention which is shown on FIGS. 13 through 19.

Figure 1:
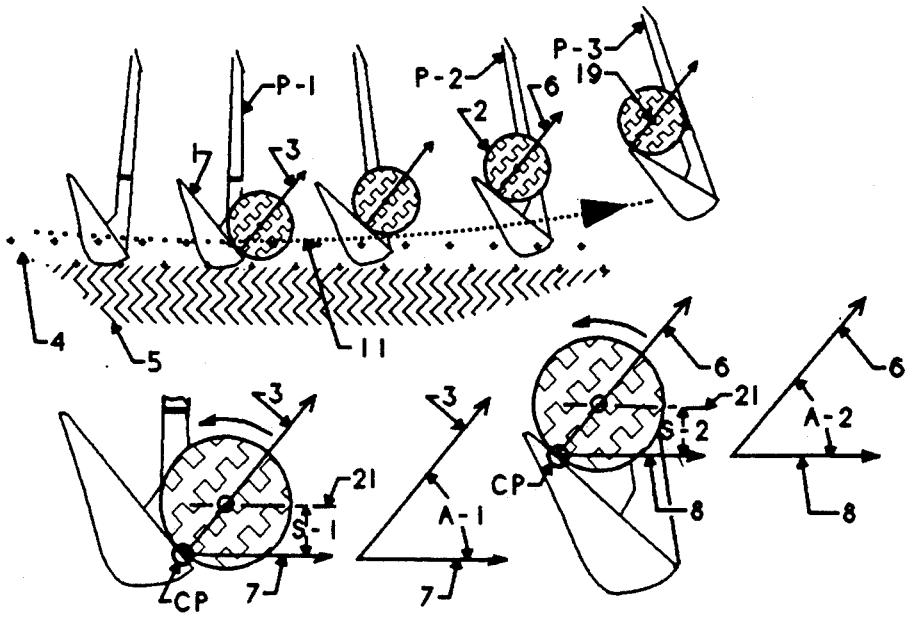
FIGS. 1 through 7 illustrate the principles of engineering mechanics which support the theory of operation of the preferred embodiment of the invention. They also serve to support the theory of a second embodiment of the invention.
Figure 2:
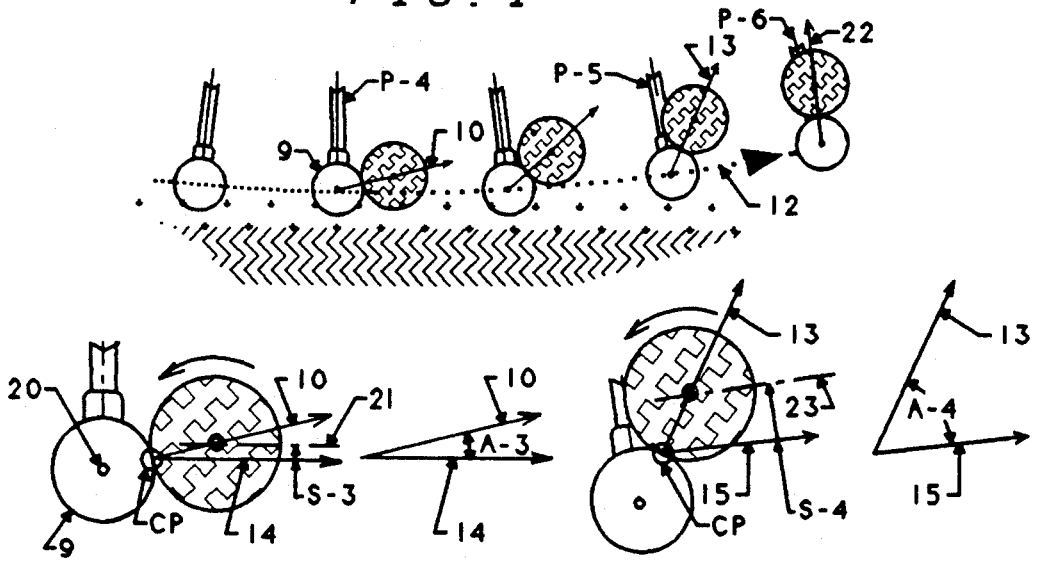

The principles of operation of the invention derive primarily from the dynamics of rotation coincident with simultaneous linear tranlation of the center of rotation, and from the conservation of momentum as applied to impact between two elastic materials. Illustrations and text presented herein are intended to show concept and utility of the invention, and should not be construed as rigorous analyses of the complex momentum phenemomena which occur between the clubhead and golf ball. The following interrelated phenomena are discussed in standard texts on the subject of engineering mechanics:

1) Relation Between Translation and Rotation For Freely Rolling Disks and Spheres In Plane Motion 2) Kinetics of Rectangular and Curvilinear Translation 3) Kinetics of Rotation 4) Rolling Resistance On a Yielding Surface 5) Linear and Angular Impulse and Momentum 6) Conservation Of Momentum 7) Elastic Impact FIGS. 1 and 2 illustrate the fundamental difference between the effect of a flat blade impulse versus the impulse of the invention on the momentum imparted to a golf ball. A No. 7 iron is one of several flat bladed clubs commonly used for chipping, and is chosen herein as depicted in FIG. 1 for comparison with the present invention. The lines of action 3 and 6 which are normal to the No. 7 iron clubhead face pass through the ball centroid 19. The angle A-2 does not change significantly from the value of A-1 as the swing arc 11 proceeds from initial impact P-1 to an intermediate point P-2 and thence to follow-through P-3. Angles A-1 and A-2 remain essentially constant at about 40 degrees from the horizontal as the swing progresses from P-1 to P-3. The angles formed are a function of loft of the club, which for a No. 7 iron is commonly 40 degrees. The actual value of A-2 would theoretically be 40 degrees plus the angle between the level ground 5 and the swing arc 11. The applied force is normal to the clubface and acts through the ball centroid for the duration of the swing, from contact P-1 to follow-through P-3. During this period, linear and rotational momentum is imparted to the golf ball. A component of force acting through the ball centroid 19 along a line of action 3 or 6 causes linear translation. A counterclockwise, or negative, rotation is caused by the moment obtained by the product of a force component acting along lines 7 or 8 multiplied by the moment arms S-1 or S-2. Lines of action 7 and 8 are parallel to the swing arc 11 at the point of contact CP. Moment arms S-1 and S-2 are measured as the perpendicular distances between lines of action 7 or 8 and a parallel line 21 passing through the ball centroid 19. The magnitude of linear and angular momentums which result are proportional to the applied clubface impulse. Since the vector directions 3 and 6 of translation and rotation 7 and 8 are substantially a function of the clubface loft, the characteristics of flight from a flat-bladed clubhead are fixed by the loft angle. The higher the iron number used for chipping, the higher will be the flight trajectory pattern.

FIG. 2 illustrates hypothetical motion of the invention clubhead 9 and ball 2 for the same swing arc and ball lie in grass 4 as shown in FIG. 1. The curvilinear velocity of the clubhead throughout the swing arc is assumed to be the same for the present invention versus the flat blade for the purpose of comparison. The clubhead 9 face is now a curve formed by an impact cylinder having a diameter smaller than the ball being struck. Lines of action which produce linear translation are established between the clubhead centroid 20 and ball centroid 19 as the swing progresses from P-4 to P-6. The line of action 10 acts to produce a low trajectory. As the swing proceeds to P-5, angle A-3 increases to A-4 and the component of applied impulse which acts along line of action 13 decreases. As the club 9 approaches P-6, the applied impulse acting along the line of action 22 approaches zero. Impulse is a direct function of force and the time duration in which it acts. The overall effect of the changing loft angle of the invention clubhead is to produce a low flight trajectory in translation, since the vertical component of applied force decreases as the swing progresses. The moment arm S-3 increases to S-4 as the parallel line 21 moves vertically with the ball centroid 19 to a new position 23. Line of action 14 moves to a new position 15. Rotational momentum is proportional to the applied impulse along the lines of action 14 and 15 and the moment arms S-3 and S-4. The component of applied impulse acting along 14 decreases at 15, while S-4 increases. The combined effect is an increase in rotational momentum. The observed results of these phenomena under actual playing conditions using several variations of the prototype invention are consistent with a low flight trajectory and a pronounced negative spin.

Figure 3:
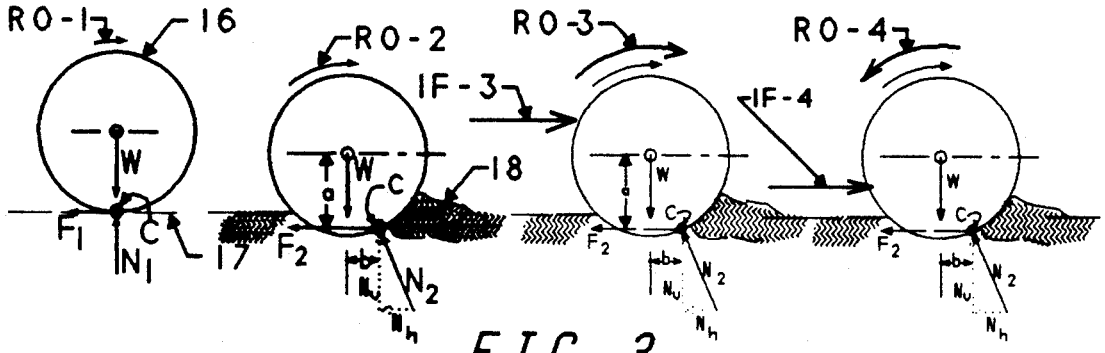

FIG. 3 illustrates a disc rolling RO-1 on a non-yielding surface 17 and against the resistance of a yielding turf surface 18. The point of rolling contact is C. The force N1, opposing W, moves to a position N2 when rolling on turf, and a resisting moment having a moment arm b is established which acts to decrease translation of the disc centroid. The moment arm b is commonly referred to as the coefficient of rolling resistance. The horizontal component Nh of N2 acts to increase F1 to F2 and increase rotation to RO-2. An impulse IF-3 acting above the centroid increases rotation to RO-3. An impulse IF-4 acting below the centroid, if of sufficient magnitude, causes a counter moment which reverses rotation to RO-4 and acts to further reduce linear translation of the centroid. From this it follows that backspin and overspin can be employed to control roll and forward motion of a golf ball.

Figure 4:
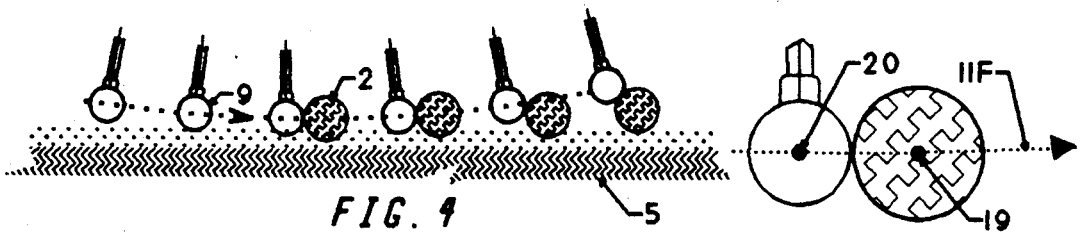
Figure 5:
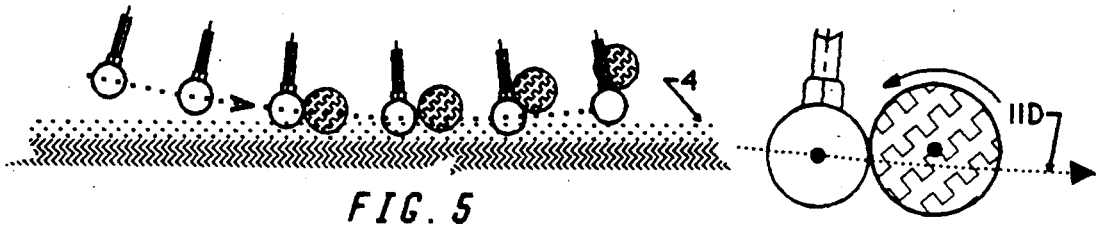
Figure 6:
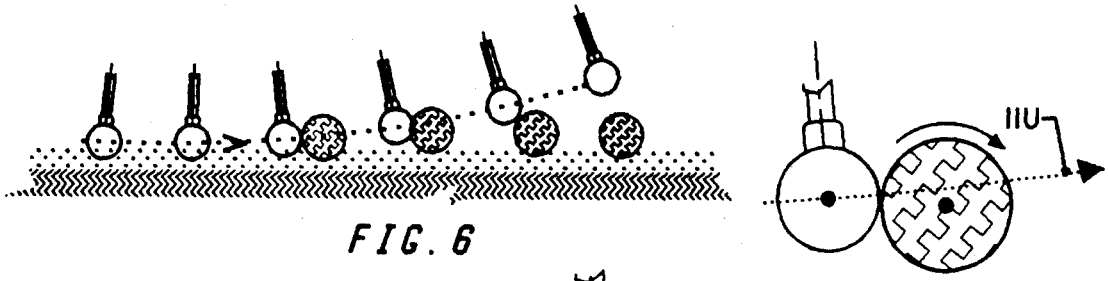

FIGS. 4, 5 and 6 illustrate typical stances and swing arcs to vary spin direction and magnitude. For a right handed golfer, the front foot is the left foot and rear is the right foot. The right handed golfer's stance in FIG. 4 is such that the ball lies about midpoint between the left and right foot, FIG. 5 toward the right foot, and in FIG. 6 it lies toward the left foot. The positive or negative direction of rotational spin, respectively called overspin and backspin, are dependent on whether the clubhead centroid 20 passes above or below the ball centroid 19. Spin momentum is proportional to the applied force, but is also dependent on frictional properties of the impacting materials. Grooving is provided on the upper and lower faces of the impact cylinder section as described hereinafter to increase the effective coefficient of friction in the downward and upward swing arc modes.

Figure 7:
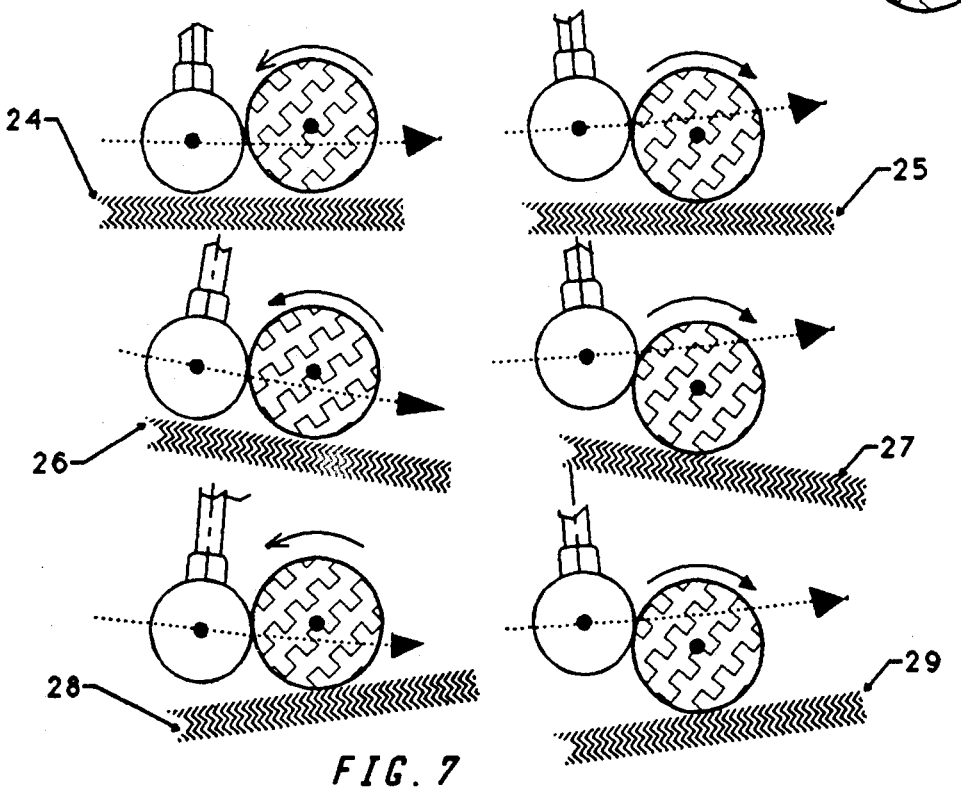

FIG. 7 illustrates several combinations of playing conditions on the putting green. Most often encountered are putts on a level green where it is required to run the ball long 25 or short 24. Other common shots require good backspin going downhill 26 and strong overspin going uphill 29. Not common, but sometimes useful overspin going downhill 29 and backspin going uphill.

As shown in FIG. 8 the preferred embodiment of the invention is a clubhead 31 which is incorporated in a golf club assembly comprising the clubhead 31, a golf club shaft 32 of standard commercial manufacture, a snugly fitted ferrule 33 of standard commercial manufacture and a grip 34 of standard commercial manufacture. The clubhead 31 which is shown in detail in FIG. 9 is made from a square strip of hardwood material which is machine turned or otherwise manufactured into a right circular cylinder. The hardwood material selected is optimized to afford the most desirable qualities among hardness, impact resilience, machinability, moisture absorbtion resistance, fungal resistance, appearance, durability, and to some degree, cost. Hardwoods provided are consistent with the properties of lignum vitae, purpleheart, bloodwood, or pernambuco. Further operations taper the bottom side at a preferred angle of eight degrees to the baseline 36 on the toe end taper 47 and the heel end taper 48. The heel face 45 is tapered a preferred twenty degrees from the vertical plane parallel to the right angular toe face 44. The impact cylinder 35 is the intended surface for stroking the golf ball. The impact cylinder diameter D is the dimension which fixes the configuration of the remainder of the clubhead, and in the preferred embodiment is established at D=1.3 inches. The impact cylinder 35 begins longitudinally at a point one diameter D from the toe toward the heel, and extends for a distance D toward the heel. The overall length of the clubhead is established at 3.5 D. Thus for a basic impact cylinder diameter of D=1.3 inches, overall club length is 3.5 D, or 4.55 inches. Grooves as shown in detail in FIG. 11, are provided longitudinally along the full length of the impact cylinder as shown in FIG. 12, and extend across the upper and lower preferred 120 degree arcs 42 and 43 of the impact cylinder face, straddling the vertical centerline 54. The grooves have preferred dimensions of 0.020 inches wide 51 by 0.020 inches deep 49 spaced on 0.080 inch centers 50 as measured along the circumference of the clubface with all corners radiused to a preferred 0.010 inches 46. Grooving is omitted and the surface is smooth on the right and left faces 52 and 53 of the impact cylinder for a preferred 60 degrees of girth on each face, centered on centerline 37. Swingweight ports 55 and 56 having a preferred diameter of ½ inch are provided on the heel 45 and toe 44 ends of the clubhead. A heavy material 38 consistent with the properties of a mixture of lead shot and lead powder is provided and inserted in the heel and toe swingweight ports to a preferred depth of ¾ inch on the heel end and 1 inch on the toe end to swingweight and balance the club assembly. The ports are closed and sealed with hardwood plugs 40 which are bonded in place by a material consistent with the characteristics of epoxy cement. The plugs are ground smooth and flush with the respective club end face after assembly. A hole having a suitable diameter and depth to match the tip end 41 of shaft 32 is provided on the centerline 54 of the top face of the clubhead and inclined 47 a preferred 20 degrees toward the heel to accept the shaft, corresponding to a club lie angle of 70 degrees. The shaft tip hole is provided with a spotface bore to accomodate the lower end of a snugly fitting ferrule 33 of standard commercial manufacture and having the characteristics of moulded plastic. The ferrule 33 has an interference force fit and is installed on the shaft prior to fixing the shaft to the invention clubhead. A metallic shaft of standard commercial manufacture suitable for golf club irons and having a preferred length of 37 inches is inserted together with its ferrule in the spotfaced shaft tip hole and bonded in place with a material having properties consistent with an epoxy cement. A grip of standard commercial manufacture suitable for golf club irons is provided and installed on the upper butt end of the shaft to complete the golf club assembly.

FIGS. 13 through 19 depict a second embodiment of the clubhead invention. This embodiment of the invention is a clubhead 57 which is incorporated in a golf club assembly comprising the clubhead 57, a golf club shaft 58 of standard commercial manufacture a gripping device 60 of standard commercial manufacture. The complete clubhead invention comprises an impact cylinder 63 provided for stroking the golf ball, toe and heel end swingweight caps 74 and 75 provided to seal the ends of the impact cylinder and swingweight and balance the golf club, and a metallic hosel 59 which is provided to connect the shaft 58 to the impact cylinder 63. The impact cylinder 63 of the clubhead is manufactured from metallic conduit or tubing having the properties of aluminum or stainless steel alloys. The outside diameter D of this tubing is a preferred 1.3 inches and the tubing has a preferred wall thickness of 0.10 inches. The tube is bent on a preferred radius of eight feet to produce the preferred uniform curvature of six degrees 63 shown between the horizontal base line 80 and a tangent 81 to the curved bottom face at the intersection with the toe and heel faces. The ends of the curved tube are cut at 90 degrees to the centerline 64 to a length of 3.5 D corresponding to a preferred length of 4.55 inches as measured along the centerline. The curved impact cylinder 63 thus formed is fitted with a toe end swingweight cap 74 and heel end swingweight cap 75. The swing weight caps are metallic consistent with the properties of brass or stainless steel and are provided with machined surfaces for a sliding fit within the inside diameter 61 of the clubhead impact cylinder and butting to the heel and toe ends of the impact cylinder wall, and are provided with machined surfaces to match the outside diameter D of the impact cylinder. Assembly of the swingweight caps in the impact cylinder toe and heel ends is made permanent by bonding the mating surfaces with a material having the characteristics of an epoxy cement. The toe and heel end swingweight cap weights are established by adjustment of length 74 and 75. Grooves, as shown in FIG. 15, are provided longitudinally along the full length of the impact cylinder as shown in FIG. 16 and extend across the upper and lower preferred 120 degree arcs 72 and 73 of the impact cylinder face, centered on centerline 71. The grooves have preferred dimensions of 0.020 inches wide 67 by 0.020 inches deep 65 preferably spaced on 0.080 inch centers 66 as measured along the circumference of the clubface, with all corners radiused to 0.010 inches 68. A metallic hosel 59 with cylindrical and conical parts and having the properties of brass, aluminum or stainless steel is provided to connect the shaft to the impact cylinder as aforementioned. The cylindrical section has a preferred diameter of 0.75 inches and fits within a hole 82 having a preferred diameter of 0.75 inches provided in the top face of the impact cylinder. The conical section has a preferred diameter of 0.20 inches at its bottom tip end and fits within a matching tapered hole 83 in the bottom face of the impact cylinder. The upper end of the hosel is provided with a hole drilled and tapered to accept a standard iron golf club shaft. The portion of the hosel fitting within the top face hole 82 is knurled 77 to provide an interference fit between the hosel and the impact cylinder. Assembly is accomlished by force fitting the hosel into the the holes 82 and 83 in the impact cylinder and by bonding the mating surfaces with a prior application of a material consistent with epoxy cement. The centerline 84 of the hosel is set at a preferred lie angle of 70 degrees above the baseline and establishes the centerline of the shaft 58. The centerline 84 of the hosel penetrates the top face of the impact cylinder at a point equal to one third of the impact cylinder length from the heel end of the impact cylinder as measured along the centerline 64 toward the toe end of the impact cylinder. A shaft of standard commercial manufacture suitable for golf club irons and having a preferred length of 37 inches is inserted in this hole and bonded in place with a material having properties consistent with an epoxy cement. A grip of standard commercial manufacture suitable for golf club irons is fitted on the upper end of the shaft.

That which is claimed is as follows:

1. A golf clubhead assembly which, when provided with a shaft, a shaft ferrule and a gripping device, can be used for chipping and putting a golf ball, the golf club assembly comprising: a solid, truncated right circular cylindrical clubhead having toe and heel ends, a shaft having a lower tip end and an upper butt end and rigidly connected at the lower tip end to the clubhead, a ferrule interfacing with the shaft and the clubhead to seal the joint therebetween; said ferrule being bonded in place with an adhesive having the characteristics of an epoxy cement, and a gripping device fitted to the upper butt end of the shaft; said clubhead having a right circular cylindrical impact cylinder having an impact surface, heel and toe end swingweight ports, swingweighting material, a means for sealing and closure of the swingweight ports; said clubhead having a right face, a left face, a top face, a bottom face, a toe end face and a heel end face; said impact cylinder intended for striking a golf ball and being circular in section; the geometry of said clubhead being derived from the applications of multiples of a base diameter "D" to develop further defining dimensions, where "D" is less than the diameter of a U.S. Golf Association regulation golf ball; the diameter of the impact cylinder being $1\times D=1.3$ inches, the length of the impact cylinder being $1\times D=1.3$ inches, the length from the toe end face to the impact cylinder along the top face being $1\times D=1.3$ inches, the length from the heel end face to the impact cylinder along the top face being $1.5\times D=2.15$ inches and the overall length of the clubhead from the toe end face to the heel end face being $3.5\times D=4.55$ inches as measured along the top face of the clubhead; said right circular cylindrical clubhead being manufactured from a hardwood material having the properties of hardness and impact resilience of lignum vitae, purpleheart, pernambuca or bloodwood; said clubhead being provided with a hole for receiving the golf club shaft in the top face of the clubhead at a distance approximately two-thirds of the overall clubhead length along the top face toward the heel; said hole having a diameter and depth to accommodate said golf club shaft and drilled at a lie angle of approximately 70 degrees above the horizontal baseline of the clubhead and corresponding to 20 degrees from the upright vertical and inclined at the upper butt end toward the heel end of the clubhead; said shaft being fitted with said ferrule wherein the ferrule is made from molded plastic; said hole in the top face of the clubhead being provided with a spotface that is countersunk to receive said ferrule; said ferrule being interference force fitted to the shaft prior to the shaft being fitted to the clubhead; said clubhead being provided with a bottom face taper on the heel end, which taper slopes upward from the impact cylinder toward the heel end face and forms an angle of approximately eight degrees with the horizontal baseline; said clubhead being provided with a bottom face taper on the toe end, which tapers upward from the impact cylinder toward the toe end face and forms an angle of approximately eight degrees with the horizontal baseline; said clubhead being provided with a heel end face taper having an angle of approximately 20 degrees from the upright vertical and inclined toward the toe end; said clubhead being provided with a toe end swingweight port comprising a hole having a diameter of approximately ½ inch in the toe end of the clubhead and drilled to a depth of approximately 1 inch; said clubhead being provided with a heel end swingweight port comprising a hole having a diameter of approximately ½ inch in the heel end of the clubhead and drilled to a depth of approximately ¾ inch; said swingweight ports being filled with said swingweighting material having the characteristics of a mixture of lead and lead powder to swingweight and balance the clubhead assembly; said ports being closed and sealed with hardwood plugs bonded in place with a material having the properties of an epoxy cement in order to contain and seal said swingweighting material in place, said plugs conforming to the shape of the heel and toe end faces; said clubhead being provided with grooves extending longitudinally along the full length of the impact surface and transversely across approximately the upper and lower 120 degree arcs of girth of the top and bottom faces, the center of said 120 degree arcs of girth being coincident with the vertical centerline of the clubhead; said clubhead being devoid of grooving over approximately a 60 degree arc of girth centered on both the left face and the right face of the impact cylinder; said longitudinal grooves having dimensions of approximately 0.02 inches wide by 0.02 inches deep and spaced on centers of approximately 0.08 inches as measured along the circumference of the impact surface, all corners of root and crown of the grooves being rounded with a radius of approximately 0.01 inches.

2. A golf clubhead assembly including a metallic hosel which, when provided with a shaft and gripping device, can be used for chipping and putting a golf ball; the golf club assembly comprising: a shaft and a gripping device, an impact cylinder having a clubface for striking a golf ball including a toe end and a heel end, and a top face, toe and heel end swingweight caps provid :d for sealing the toe and heel ends, respectively, of the impact cylinder and for swingweight balancing the golf clubhead assembly; the impact cylinder being manufactured from metallic tubing from the group consisting of aluminum, brass or stainless steel alloys; the outside diameter "D" of said tubing being approximately 1.3 inches and the tubing having a wall thickness of approximately 0.10 inches; said tubing being bent to a curved tube on a radius of approximately eight feet to produce a uniform curvature and included angle of approximately six degrees between the horizontal baseline and a tangent to a curved bottom face at the intersection of the toe and heel ends of the impact cylinder; the toe and heel ends of the curved tube being cut at approximately 90 degrees to the curved longitudinal centerline of the impact cylinder to a length of 3.5×D corresponding to a length of approximately 4.55 inches as measured along the centerline; said swingweight caps being metallic and selected from the group consisting of brass or stainless steel; said swingweight caps having different masses accounted for by variation of length only, the diameters of said swingweight caps being fixed by the matching outside and inside diameters of the impact cylinder; said swingweight caps being provided with machined surfaces for a sliding fit within the inside diameter of the impact cylinder; said swingweight caps having shoulders abutting a wall of the impact cylinder at the heel and toe ends; said swingweight caps being provided with machined surfaces to match the outside diameter "D" of the impact cylinder; the impact cylinder being provided with grooves for creating a spin effect on a golf ball; said grooves being provided longitudinally along the full length of the impact cylinder and extending across approximately the upper and lower 120 degree arcs of the top and bottom faces of the impact cylinder; said grooves having dimensions of approximately 0.020 inches wide by 0.020 inches deep and spaced on 0.080 inch centers as measured along the circumference of the clubface; said grooves having all corners radiused to 0.010 inches; said metallic hosel manufactured with cylindrical and conical parts and from material selected from the group consisting of aluminum or stainless steel; said hosel being provided for connecting said golf club shaft to the impact cylinder; the cylindrical section of said hosel having a diameter of approximately 0.75 inches and fitting within a hole having a diameter of approximately 0.75 inches provided in the top face of the impact cylinder; the conical section of the hosel having a diameter of approximately 0.20 inches as a bottom tip end and fitting within a matching tapered hole in the bottom face of the impact cylinder; an upper end of the hosel being provided with a hole drilled and tapered to accept said shaft; the portion of the hosel fitting within the top face being knurled to provide an interference fit between the hosel and the impact cylinder; said hosel being bonded with a material having the properties of an epoxy cement; the centerline of the hosel being set at a lie angle of approximately 70 degrees above the horizontal baseline of the clubhead and establishing the centerline of the shaft, the centerline of the hosel penetrating the top face of the impact cylinder at a point equal to one third of the impact cylinder length from the heel end toward the toe end of the impact cylinder; said shaft having a length of approximately 37 inches; said gripping device being fitted on an upper end of the shaft.

* * * * *